United States Patent [19]

Twist et al.

[11] Patent Number: 4,482,626

[45] Date of Patent: Nov. 13, 1984

[54] PHOTOGRAPHIC COLOR DEVELOPER COMPOSITIONS

[75] Inventors: Peter J. Twist, Great Missenden; Joseph Bailey, Bushey Heath; Stuart P. Briggs, London; Miroslav V. Mijovic, Watford; David T. Southby, Rayners Lane, all of England

[73] Assignee: Eastman Kodak Company, Rochester, N.Y.

[21] Appl. No.: 594,945

[22] Filed: Mar. 30, 1984

Related U.S. Application Data

[63] Continuation of Ser. No. 474,772, Mar. 14, 1983, abandoned.

[30] Foreign Application Priority Data

Apr. 29, 1982 [GB] United Kingdom ..... 8212463

[51] Int. Cl.[3] ..... G03C 5/30

[52] U.S. Cl. ..... 430/380; 430/376; 430/467; 430/490; 430/491

[58] Field of Search ..... 562/444, 430; 430/435, 430/484, 436, 442, 467, 468, 469, 490, 491, 478, 479, 239, 249, 250, 357, 376, 380

[56] References Cited

U.S. PATENT DOCUMENTS

| | | | |
|---|---|---|---|
| 2,875,049 | 2/1959 | Kridel | 430/467 |
| 3,462,269 | 8/1969 | Tassone | 430/467 |
| 3,716,361 | | 430 | 376/ |
| 4,264,716 | 4/1981 | Vincent et al. | 430/380 |

FOREIGN PATENT DOCUMENTS

| | | | |
|---|---|---|---|
| 25633 | 2/1977 | Japan | 430/491 |

OTHER PUBLICATIONS

"Sequestrants and Hydroxylamine Stability" by P. J. Twist, 1982 International Congress of Photographic Science, Cambridge, U.K., Sep. 6-10, 1982.

*Primary Examiner*—Mary F. Downey
*Attorney, Agent, or Firm*—Alfred P. Lorenzo

[57] ABSTRACT

Photographic color developer compositions containing a primary aromatic amino color developing agent and an hydroxylamine are stabilized by incorporating therein certain polyamino stabilizing agents, such as N,N'-bis(2-hydroxybenzyl)ethylenediamine-N,N'-diacetic acid. Decomposition of the hydroxylamine, in the presence of heavy metals such as iron which act to catalyze the decomposition, and resultant formation of ammonia is effectively prevented by the presence in the developer composition of such stabilizing agents. Undesirable precipitate formation is also effectively avoided.

30 Claims, No Drawings

PHOTOGRAPHIC COLOR DEVELOPER COMPOSITIONS

This is a continuation of application Ser. No. 474,772, filed Mar. 14, 1983 now abandoned.

FIELD OF THE INVENTION

This invention relates in general to color photography and in particular to new and improved color developing compositions and processes for forming photographic color images. More specifically, this invention relates to color development with a color developing composition, containing a primary aromatic amino color developing agent and an hydroxylamine, which is stabilized by the presence of certain polyamino stabilizing agents.

BACKGROUND OF THE INVENTION

The formation of color photographic images by the image-wise coupling of oxidized primary aromatic amino developing agents with color forming or coupling compounds to form indoaniline, indophenol, and azomethine dyes is well known. In these processes, the subtractive process of color formation is ordinarily used and the image dyes customarily formed are cyan, magenta, and yellow, the colors that are complementary to the primary colors, red, green, and blue, respectively. Usually phenol or naphthol couplers are used to form the cyan dye image; pyrazolone or cyanoacetyl derivative couplers are used to form the magenta dye image; and acylacetamide couplers are used to form the yellow dye image.

In these color photographic systems, the color-forming coupler may be either in the developer solution or incorporated in the light-sensitive photographic emulsion layer so that, during development, it is available in the emulsion layer to react with the color developing agent that is oxidized by silver image development. Diffusible couplers are used in color developer solutions. Nondiffusing couplers are incorporated in photographic emulsion layers. When the dye image formed is to be used in situ, couplers are selected which form non-diffusing dyes. For image transfer color processes, couplers are used which will produce diffusible dyes capable of being mordanted or fixed in the receiving sheet.

In addition to a primary aromatic amino color developing agent, photographic color developing compositions frequently contain hydroxylamine or a salt thereof which functions to protect the developing agent against aerial oxidation. They also generally contain a sequestering or chelating agent to stabilize the composition against the formation of precipitates and against undesired decomposition reactions, such as the decomposition of the hydroxylamine to generate ammonia. A variety of sequestering agents or combinations of sequestering agents have been proposed in the past for use in stabilizing photographic color developing compositions containing a primary aromatic amino color developing agent and an hydroxylamine. For example, sequestering agents described as being useful for this purpose include the 1,3-diamino-2-propanol tetraacetic acid of U.S. Pat. No. 2,875,049; the diethylenetriamine pentaacetic acid of U.S. Pat. No. 3,462,269; the combination of an aminopolycarboxylic acid and an aromatic polyhydroxy compound of U.S. Pat. No. 3,746,544; the combination of an amino-N,N-dimethylenephosphonic acid and a diphosphonic acid described in Research Disclosure, Volume 134, Item 13410, June 1975; the combination of an hydroxyalkylidene diphosphonic acid and an aminopolycarboxylic acid or of an hydroxyalkylidenediphosphonic acid and an aminopolyphosphonic acid of U.S. Pat. No. 3,994,730; the organic compounds having at least one phosphono group and at least one carboxy group in the molecule described in U.S. Pat. No. 4,083,723; the combination of an aminophosphonic acid and an aminocarboxylic acid described in Research Disclosure, Volume 170, Item 17048, June 1978, the combination of an aminopolyphosphonic acid compound and an aromatic polyhydroxy compound described in U.S. Pat. No. 4,264,716 and the alkylenediamine-di-(o-hydroxyphenylacetic acids) or alkali metal salts thereof of Japanese patent application No. 52-25633 published Feb. 25, 1977. However, in many cases the sequestering agents or sequestering agent combinations proposed in the prior art provide less than satisfactory results in respect to one or both of the aspects of avoiding precipitate formation and avoiding decomposition reactions. This is particularly the case under severe conditions when heavy metals, such as iron, which act to catalyze the decomposition of the hydroxylamine are present in the developer composition in substantial quantities.

It is toward the objective of providing a photograhic color developing composition which has excellent stability in respect to both avoiding undesired precipitates and avoiding the harmful effects of decomposition that the present invention is directed.

SUMMARY OF THE INVENTION

In accordance with this invention, it has been discovered that photographic color developing compositions containing a primary aromatic amino color developing agent and an hydroxylamine can be effectively stabilized against both precipitate formation and decomposition reactions by incorporating therein certain polyamino stabilizing agents as hereinafter described. Photographic color developing compositions stabilized in this manner resist the formation of precipitates of calcium, or other metals, and undergo only a slight degree of decomposition of the hydroxylamine under typical conditions of use.

The polyamino stabilizing agents utilized in the photographic color developing compositions of this invention are represented by the general formula:

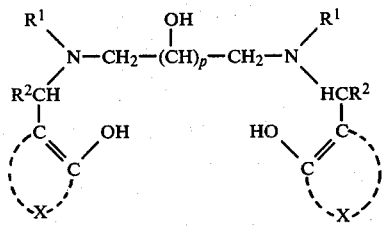

(I)

wherein each $R^1$ is $—CH_2COOH$ or

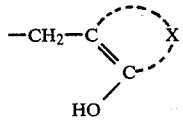

each $R^2$ is hydrogen or —COOH p is 0 or 1, and

X represents the atoms necessary to complete an aromatic nucleus which can, if desired, include other substituents in addition to the hydroxyl group.

The preferred stabilizing agents have the general formula:

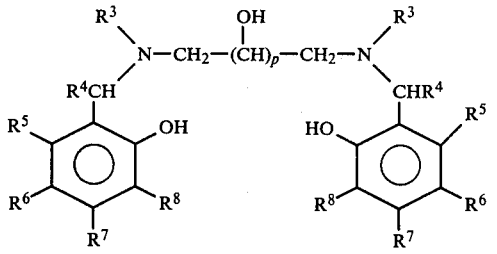

(II)

wherein each $R^3$ is $—CH_2—COOH$, or

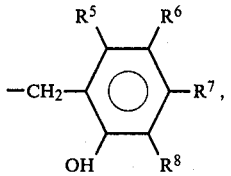

each $R^4$ is hydrogen or —COOH, each $R^5$, $R^6$, $R^7$ and $R^8$ is hydrogen, —COOH, $—SO_3H$, alkyl of 1 to 4 carbon atoms optionally substituted by a —COOH, $—SO_3H$, or —OH group, alkoxy of 1 to 4 carbon atoms optionally substituted by a —COOH, $—SO_3H$ or —OH group, or each $R^6$ together with $R^5$ or $R^7$, or each $R^8$ together with $R^7$ represents a fused benzene ring which may itself be substituted, e.g., with one or more of the groups specified for $R^5$ to $R^8$, and p is 0 or 1.

In formula (I), the substituents represented by the symbol $R^1$ can be the same or different, i.e., they are selected independently. For example, the $R^1$ group attached to one of the nitrogen atoms can be $CH_2COOH$ while the $R^1$ group attached to the other nitrogen atom can be

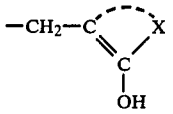

Similarily, the substituents represented by $R^2$ in formula (I) and by $R^3$ through $R^8$ in formula (II) can be the same or different.

In formula (II), both $R^3$ groups are preferably $—CH_2COOH$, and the preferred alkyl and alkoxy group have 1 or 2 carbon atoms and may be advantageously substituted with —COOH or —OH groups.

If the $R^6$ position is unsubstituted or substituted with a group that can be displaced on reaction with oxidized color developer, coupling can take place with the formation of a dye. This might lead to the formation of stain in the processed photographic material. Such stain can be avoided if $R^6$ is a group which blocks the normal coupling position, e.g., an alkyl group having 1–4 carbon atoms. Advantageously, $R^8$ is also such a blocking group.

DESCRIPTION OF THE PREFERRED EMBODIMENTS

The primary aromatic amino color developing agents that are utilized in the compositions and methods of this invention are well known and widely used in a variety of color photographic processes. They include aminophenols and p-phenylenediamines. They are usually used in the salt form, such as the hydrochloride or sulfate, as the salt form is more stable than the free amine, and are generally employed in concentrations of from about 0.1 to about 20 grams per liter of developing solution and more preferably from about 0.5 to about 10 grams per liter of developing solution.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include:

N,N-diethyl-p-phenylenediamine monohydrochloride,

4-N,N-diethyl-2-methylphenylenediamine monohydrochloride, 4-(N-ethyl-N-2-methanesulfonylaminoethyl)-2-methylphenylenediamine sesquisulfate monohydrate, 4-(N-ethyl-N-2-hydroxyethyl)-2-methylphenylenediamine sulfate, 4-N,N-diethyl-2,2'-methanesulfonylaminoethylphenylenediamine hydrochloride, and the like.

An especially preferred class of p-phenylenediamine developing agents are those containing at least one alkylsulfonamidoalkyl substituent attached to the aromatic nucleus or to an amino nitrogen. Other especially preferred classes of p-phenylenediamines are the 3-alkyl-N-alkyl-N-alkoxyalkyl-p-phenylenediamines and the 3-alkoxy-N-alkyl-N-alkoxyalkyl-p-phenylenediamines. These developing agents are described in U.S. Pat. Nos. 3,656,950 and 3,658,525, and can be represented by the formula:

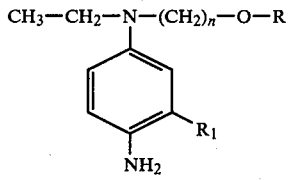

wherein n is an integer having a value of from 2 to 4, R is an alkyl group of from 1 to 4 carbon atoms, and $R^1$ is an alkyl group of from 1 to 4 carbon atoms or an alkoxy group of from 1 to 4 carbon atoms. Illustrative examples of these developing agents include the following compounds:

N-ethyl-N-methoxybutyl-3-methyl-p-phenylenediamine,

N-ethyl-N-ethoxyethyl-3-methyl-p-phenylenediamine,

N-ethyl-N-methoxyethyl-3-n-propyl-p-phenylenediamine,
N-ethyl-N-methoxyethyl-3-methoxy-p-phenylenediamine,
N-ethyl-N-butoxyethyl-3-methyl-p-phenylenediamine, and the like.

In addition to the primary aromatic amino color developing agent, the developing compositions of this invention contain an hydroxylamine. Hydroxylamine can be used in the color developing composition in the form of the free amine, but is more typically employed in the form of a water-soluble acid salt. Typical examples of such salts are sulfates, oxalates, chlorides, phosphates, carbonates, acetates, and the like. The hydroxylamine can be substituted or unsubstituted, for example, the nitrogen atom of the hydroxylamine can be substituted with alkyl radicals. Preferred hydroxylamines are those of the formula:

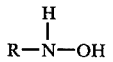

wherein R is a hydrogen atom or an alkyl group of 1 to 3 carbon atoms, and water-soluble acid salts thereof.

Typical examples of the hydroxylamines that are useful in the color developing compositions of this invention include:

hydroxylamine sulfate (HAS)
hydroxylamine hydrochloride,
hydroxylamine phosphate,
N-methylhydroxylamine hydrochloride,
N,N-diethylhydroxylamine, and the like.

Optional ingredients which can be included in the color developing compositions of this invention include alkalies to control pH, thiocyanates, bromides, chlorides, iodides, benzyl alcohol, sulfites, thickening agents, solubilizing agents, brightening agents, wetting agents, stain reducing agents, and so forth. The pH of the developing solution is ordinarily above 7 and most typically about 10 to about 13.

The hydroxylamine is preferably included in the color developing composition in an amount of from about 1 to about 8 moles per mole of primary aromatic amino color developing agent, more preferably in an amount of from about 2 to about 7 moles per mole, and most preferably in an amount of from about 3 to about 5 moles per mole.

Development of photographic elements in the color developing compositions described herein can be advantageously employed in the processing of photographic elements designed for reversal color processing or in the processing of negative color elements or color print materials. The polyamino stabilizing agents described herein can be employed with photographic elements which are processed in color developers containing couplers or with photographic elements which contain the coupler in the silver halide emulsion layers or in layers contiguous thereto. The photosensitive layers present in the photographic elements processed according to the method of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

The stabilizing agents of formula (I) can be used alone or in combination with another sequestering or chelating agent, for example, an aminopolycarboxylic acid chelating agent or an aminopolyphosphonic acid chelating agent.

Typical examples of the aminopolycarboxylic acid chelating agents include:

nitrilotriacetic acid, (NTA)
ethylenediaminetetraacetic acid, (EDTA)
1,3-diamino-2-propanol-N,N,N',N'-tetraacetic acid, (DPTA)
diethylenetriaminepentaacetic acid (DTPA)
hydroxyethylethylenediaminetriacetic acid,
cyclohexanediaminotetraacetic acid,
aminomalonic acid, and the like.

Among the useful aminopolyphosphonic acid chelating agents are the following:

(1) amino-N,N-dimethylenephosphonic acids of the formula:

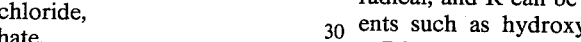

$$R—N(CH_2PO_3M_2)_2$$

wherein M is a hydrogen atom or a monovalent cation and R is an alkyl group, an aryl group, an aralkyl group, an alkaryl group, an alicyclic group or a heterocyclic radical, and R can be further substituted with substituents such as hydroxyl, halogen, an alkoxy group, a $—PO_3M_2$ group, a $—CH_2PO_3M_2$ group, or an $—N(CH_2PO_3M_2)_2$ group;

(2) aminodiphosphonic acid of the formula:

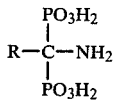

in which R is an alkyl group, preferably of one to five carbon atoms, and (3) N-acylaminodiphosphonic acids of the formula:

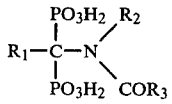

where $R_1$, $R_2$ and $R_3$ are hydrogen or an alkyl group, preferably alkyl of one to five carbon atoms.

Typical examples of the aminopolyphosphonic acid chelating agents useful in the novel color developing compositions of this invention include:

1-aminoethane-1,1-diphosphonic acid,
1-aminopropane-1,1-diphosphonic acid,
N-acetyl-1-aminoethane-1,1-diphosphonic acid,
ethylenediamine-N,N,N',N'-tetramethylenephosphonic acid,
nitrilo-N,N,N-trimethylenephosphonic acid,
1,2-cyclohexanediamine-N,N,N',N'-tetramethylenephosphonic acid,
o-carboxyanilino-N,N-dimethylenephosphonic acid
propylamino-N,N-dimethylenephosphonic acid,
4-(N-pyrrolidino)butylamine-N,N-bis-methylenephosphonic acid,
1,3-diaminopropanol-N,N,N',N'-tetramethylenephosphonic acid, 1,3-propanediamine-N,N,N',N'-tetramethylenephosphonic acid,
1,6-hexanediamine-N,N,N',N'-tetramethylenephosphonic acid,
o-acetamidobenzylamino-N,N-dimethylenephosphonic acid,
o-toluidine-N,N-dimethylenephosphonic acid,
2-pyridylamino-N',N'-dimethylenephosphonic acid,
diethylenetriamine pentamethylenephosphonic acid, and the like.

$R^2$ is hydrogen and those wherein $R^6$ and/or $R^8$ are alkyl or alkoxy.

The choice of calcium-chelating agent in such cases is wide, but best results will be obtained when a calcium sequestrant having poor iron-chelating properties is chosen, e.g., 1,3-diamino-2-propanol-N,N,N',N'-tetraacetic acid. This is because, again, there is no competition between the two chelating agents for iron and calcium.

The preferred compounds of formula (I) include:

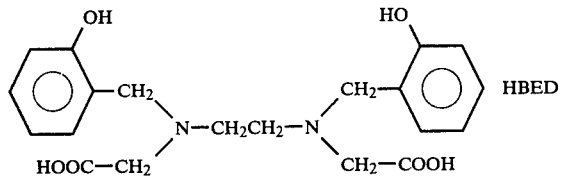

N,N'—bis(2-hydroxybenzyl)ethylenediamine-N,N'—diacetic acid

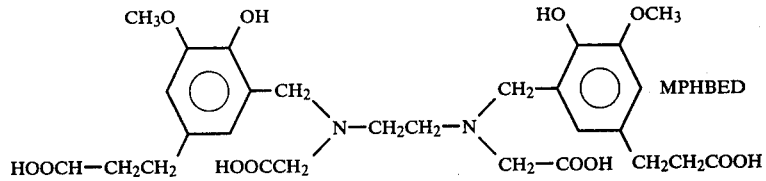

N,N'—bis(3-carboxymethyl-6-hydroxybenzyl)ethylenediamine-N,N'—diacetic acid

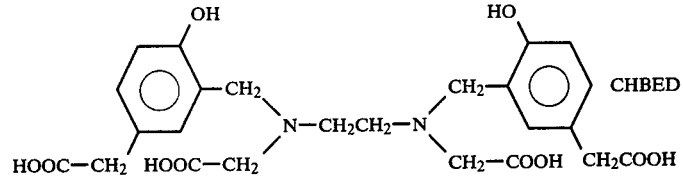

N,N'—bis(3-carboxymethyl-6-hydroxybenzyl)ethylenediamine-N,N'—diacetic acid

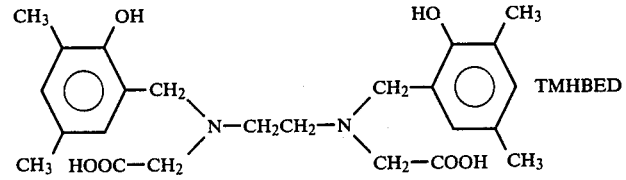

N,N'—bis(3,5-dimethyl-6-hydroxybenzyl)ethylenediamine-N,N'—diacetic acid

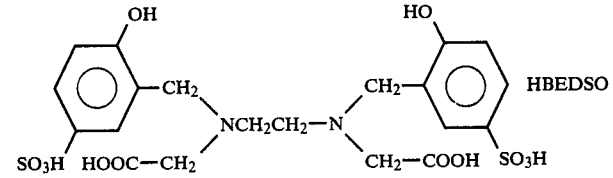

N,N'—bis(3-sulfo-6-hydroxybenzyl)ethylenediamine-N,N'—diacetic acid

Certain compounds of formula (I) are, for reasons that are not clearly understood, unable to form soluble complexes with calcium ions. Hence, in such a case, another chelating agent is preferably used to form calcium complexes. This is, in certain instances, a considerable advantage because iron and copper can be more efficiently complexed where there is no competition from calcium. This leads to better suppression of hydroxylamine decomposition and ammonia generation. Such compounds of formula (I) include those wherein The compound HBED which is referred to herein as N,N'-bis(2-hydroxybenzyl)ethylenediamine-N,N'-diacetic acid can also be referred to as ethylenedinitrilo-N,N'-bis(2-hydroxybenzyl)-N,N'-diacetic acid.

The particularly preferred compounds of formula (I) form complexes with iron (III) which have polarographic half-wave potentials measured in a solution having a carbonate buffer at pH 10 more negative than −600 mV, preferably from −600 to −800 mV; SCE (Saturated Calomel Electrode).

Examples of such half-wave potentials of some iron (III) complexes with the above compounds are as follows:

| | |
|---|---|
| HBED | −626 mV; SCE |
| HBEDSO | −530 |
| TMHBED | −703 |
| MPHBED | −672 |
| CHBED | −658 |

It can be seen that HBEDSO is not a member of the above particularly preferred group of compounds of formula (I).

The stabilizing agents of formula (I) can be employed in a wide range of concentrations, for example from 0.1 to 10 g/l depending on their solubility, preferably from 1 to 5 g/l. In combination with other chelating agents, they can be used in concentrations of from 0.01 to 10 g/l, preferably from 0.1 to 1.0 g/l, the other chelating agent being used in amounts of 0.5 to 10 g/l, preferably 1 to 5 g/l.

References of interest in connection with the synthesis of polyamino compounds of the type employed as stabilizing agents herein include:

U.S. Pat. Nos. 2,967,196, 3,632,637, 3,758,540

USSR Pat. No. 273,207 (CA 74-22532e)

Mem. Fac. Sci. Kyushu Univ. Ser. C 8 (1) 25-8 (1972)-CA 76-140123 m.

Mori et al, Bull. Chem. Soc. Japan, 35, 75–77, (1962).

L. D. Taylor, et al, J. Org. Chem., 43, 1197, (1978).

F. L'Eplattenier et al, J. A. C. S., 88, 837, (1966).

Certain of the compounds of formula (I) can be prepared by a Mannich reaction as follows:

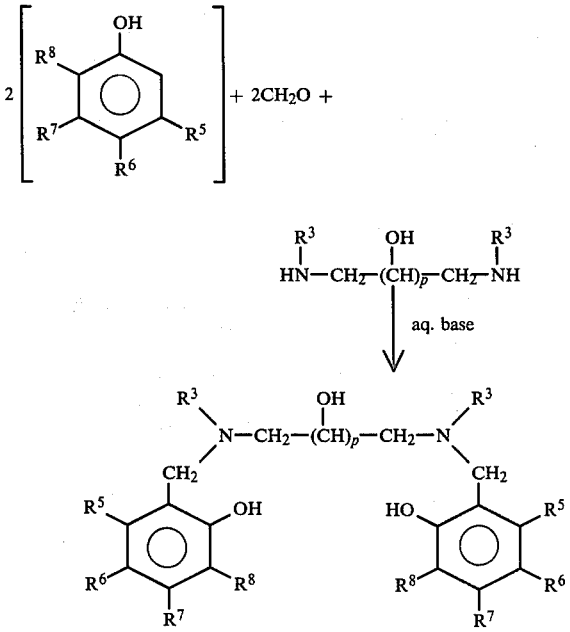

Other compounds of formula (I) wherein $R^2$ is —COOH can be prepared by the method described in J. A. C. S., 79, 2024–5 (1957).

Several examples of preparation of compounds of formula (I) follow below.

Preparation of CHBED (N,N'-bis(3-carboxymethyl-6-hydroxybenzyl)ethylenediamine-N,N'-diacetic acid)

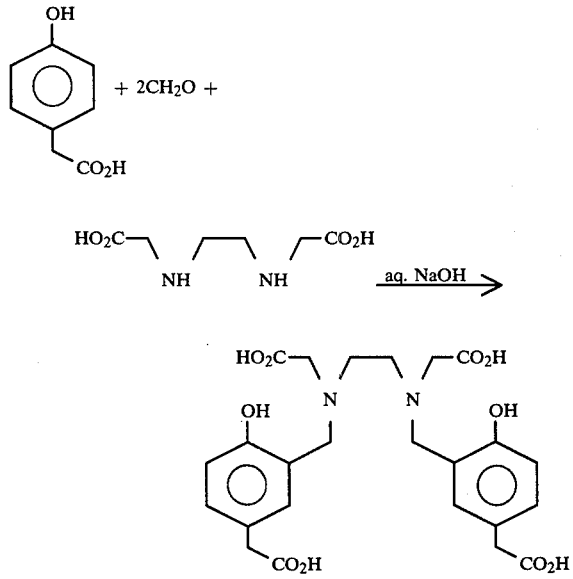

Sodium hydroxide (20 g, 0.5 mol) dissolved in water (40 ml) was treated with ethylenediamine-N,N'-diacetic acid (17.6 g, 0.1 mol) and the resultant solution allowed to cool to room temperature. Para-hydroxyphenylacetic acid (38 g, 0.25 mol) was added and stirring continued until a homogeneous solution was obtained; then formaldehyde (38% aqueous solution, 15.8 ml, 0.2 mol) was run in and the temperature raised to 70° C. After 5 hours, the reaction mixture was diluted with cold water (100 ml) and acidified to a pH of 3 with concentrated hydrochloric acid. Acidification caused a white gum to precipitate. The aqueous supernatant was decanted and the gum was scrubbed with water (3×50 ml) and then ethyl acetate (2×50 ml). Finally, the gum was dissolved in methanol and the product was precipitated as a white powder by dilution with ethyl acetate. Yield=34 g (67%).

Subsequent analysis of the product obtained from the synthesis of CHBED above indicates that the product contains substantial quantities of by-products. The high pH conditions promote hydroxymethylation as well as the desired Mannich reaction giving rise to a variety of products as shown below.

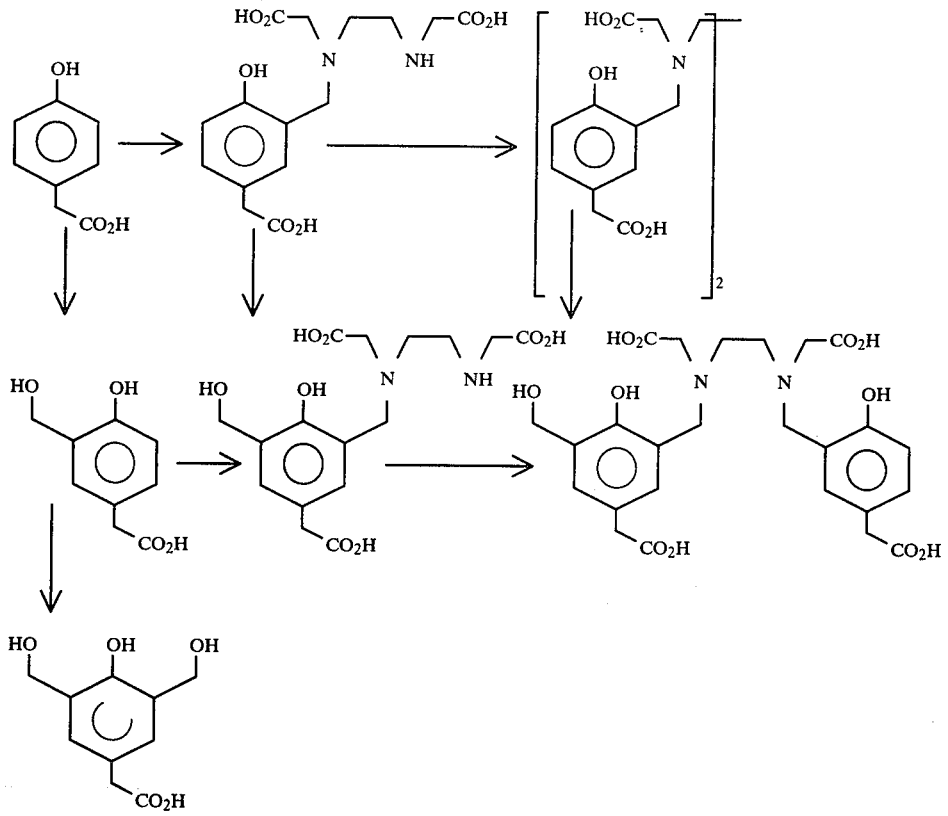

It is also possible that some phenolformaldehyde polymerization to form dimers or trimers could occur, although these have not been detected.

The problem of hydroxymethylation can be overcome by lowering the pH to near neutral and conducting the reaction at a lower temperature over a longer period of time.

Alternative preparation of N,N'-bis(3-carboxymethyl-6-hydroxybenzyl)ethylenediamine-N,N'-diacetic acid, CHBED

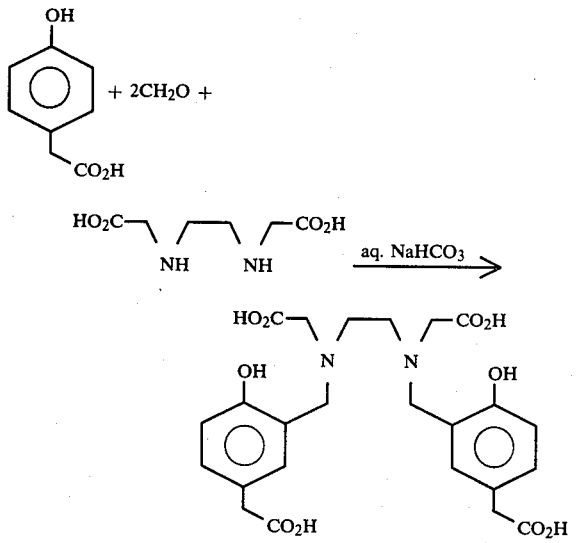

Ethylenediamine-N,N'-diacetic acid (61.6 g, 0.35 mol) and sodium hydrogen carbonate (58.8 g, 0.7 mol) were suspended in water (250 ml) and stirred for 2 hours, by which time nearly all the solid had dissolved. Para-hydroxyphenylacetic acid (106.4 g, 0.7 mol) was added in portions over 1 hour; then formaldehyde (38% aqueous solution, 55.2 ml, 0.7 mol) was added during 15 minutes. The mixture was stirred overnight at 20° C. and then the temperature was raised to 58° C. for 9 hours and then allowed to cool back to 20° C. overnight. The cool solution was acidified to pH 4 with conc. hydrochloric acid which caused a white gum to separate. The supernatant liquid was decanted and the gum thoroughly washed with water (4×50 ml), then ethyl acetate (4×50 ml) and finally methanol 5×50 ml). Washing with methanol converted the white gum into a granular solid. Yield=98 g (56%).

It is believed that CHBED can be made most simply as the dipotassium salt. The dipotassium salt can be prepared in a higher yield than the free carboxylic acid and is more rapidly dissolved in aqueous solutions then CHBED. The only disadvantage associated with this preparation is that the product is initially a sticky gum and may present handling problems.

Preparation of dipotassium N,N'-bis(3-carboxymethyl-6-hydroxybenzyl)ethylenediamine-N,N'-diacetate, CHBED $K_2$ salt

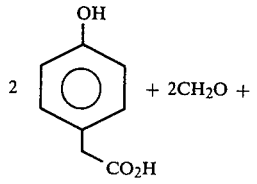

-continued

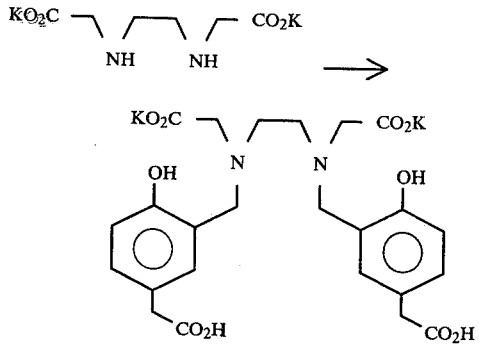

Ethylenediamine-N,N'-diacetic acid (8.8 g, 0.05 mol) and potassium hydroxide (5.6 g, 0.1 mol) were dissolved in water (50 ml). Aqueous formaldehyde (38% solution, 9.86 ml, 0.125 mol) and then para-hydroxyphenylacetic acid (19.0 g, 0.125 mol) were added and the resultant mixture stirred to give a homogeneous solution of pH 5. The solution was heated at 60° C. for 24 hours, cooled to room temperature and washed with ethyl acetate (4×30 ml). The solution of crude CHBED $K_2$ salt was diluted with ethanol (350 ml) which caused the product to separate out as a gum. After decanting the supernatant, the gum was dried in vacuo, affording a white foamy solid, 24.46 g (84% yield).

When an aqueous solution of CHBED $K_2$ salt containing potassium carbonate was titrated against aqueous calcium chloride, 91% of an equivalent of calcium was sequestered before precipitation of calcium carbonate occurred. Various batches of CHBED $K_2$ salt have sequestered from 80 to 98% of an equivalent of calcium depending on the level of contamination with water and the mono-Mannich product.

Preparation of MPHBED
(N,N'-bis(3-[2-carboxyethyl]-6-hydroxy-5-methoxybenzyl)-ethylenediamine-N,N'-diacetic acid)

Ethylenediamine-N,N'-diacetic acid (4.4 g, 0.025 mol) was dissolved in a mixture of aqueous sodium hydroxide (7 ml, 30%) and methanol (13 ml). To this solution was added formaldehyde (4.1 g, 38%) in methanol (15 ml) followed by 3-(4-hydroxy-3-methoxyphenyl)propionic acid (10 g, 0.05 mol) in methanol (13 ml) and aqueous sodium hydroxide (6.7 ml, 30%).

The mixture was boiled gently with constant stirring for 8 hours under reflux.

The solvent was removed under reduced pressure at 50°–70° C. and the residue dissolved in hot methanol (100 ml).

The insoluble impurities were removed by filtration.

The filtrate was added dropwise to ethyl acetate (200 ml) with stirring. The white precipitate was twice washed with an ethyl acetate/methanol mixture (2:1, 60 ml total volume). The precipitate, which was deliquescent, was dissolved in water (100 ml), shaken with ethyl acetate (100 ml), and the water layer separated. The non-aqueous phase was washed with additional water (40 ml).

The combined aqueous extracts were acidified with sulfuric acid (about 8.5 ml, 6M) to pH 2 (Merck narrow range pH paper) with continuous stirring. A brown oil formed followed by a white precipitate. After leaving for two days the solid (8.7 g) was collected by filtration and powdered. Yield about 75%.

The analysis sample was dried under reduced pressure at 40° C. over $P_2O_5$.

Microanalysis $C_{28}H_{36}N_2O_{12}$; Requires: C, 56.7; H, 6.1; N, 4.7; Found: C, 56.06; H, 6.12; N, 4.4.

The following examples illustrate the effect of the polyamino stabilizing agents of this invention on alkaline solutions containing hydroxylamine sulfate (HAS) and added iron salt as contaminant as well as on color developer solutions containing HAS and iron contaminant.

EXAMPLE 1

Eight solutions were prepared and examined over a three week period for ammonia and hydroxylamine content. The solutions consisted of potassium carbonate (30.6 g/l), hydroxylamine sulfate (3.9 g/l), ferric nitrate (0.072 g/l) and a stabilizing agent of the invention ($1.9\times10^{-3}$M). For comparative purposes, other solutions were tested containing no iron contaminant and containing known chelating agents heretofore proposed for use in photographic color developing solutions. The results obtained with these solutions are shown in Table I.

TABLE I

| Solution | Iron | Stabilizing Agent | Ammonia levels (ppm) 1 week | 2 weeks | 3 weeks | HAS levels (g/l) 1 week | 2 weeks | 3 weeks |
|---|---|---|---|---|---|---|---|---|
| 1 | + | HBED | 1.3 | 2.1 | 3.1 | 3.54 | 3.35 | 2.75 |
| 2 | − | HBED | 1.3 | 1.6 | 3.0 | 3.90 | 3.34 | 2.97 |
| 3 | − | — | 1.5 | 1.8 | 2.6 | 3.20 | 2.03 | 1.13 |
| 4 | + | — | 10.9 | 18.1 | 27.0 | 2.98 | 1.42 | 0.03 |
| 5 | + | DTPA | 22.6 | 39.0 | 40.9 | 3.41 | 1.69 | 0.34 |
| 6 | + | EDTA | 183.6 | 184 | 147.6 | 0.19 | 0.21 | 0.19 |
| 7 | + | TIRON* | 2.2 | 2.7 | 4.1 | 3.19 | 2.04 | 1.06 |

*"TIRON" is a trademark for 4,5-dihydroxy-m-benzenedisulfonic acid sodium salt.

The results in Table I illustrate that HBED gives very good control of the effect of iron on HAS decomposition. HBED (1) in the presence of iron gives results close to those without iron (2) and is generally more effective than the other sequestrants in controlling iron catalysis of HAS decomposition. Only TIRON (7) comes close to HBED in giving very low ammonia levels, but does not maintain the level of HAS so effectively.

EXAMPLE 2

A number of solutions were prepared in order to assess the stability of hydroxylamine in alkaline carbonate solution, in the presence of 10 ppm of ferric iron and various stabilizing agents according to the invention. The solutions were aged in dark bottles at 25° C. and stoppered with cotton wool plugs.

| Solution Composition | |
|---|---|
| Hydroxylamine sulfate | 3.9 g/l |
| Potassium carbonate | 30.6 g/l |

-continued

| Solution Composition | |
|---|---|
| Stabilizing agent | $1.9 \times 10^{-3}$ M |
| Ferric Nitrate.$9H_2O$ | 0.072 g/l (≡ 10 ppm Iron) |
| pH | 10.0 |

The stabilizing agents used and the results obtained are shown in the following table.

TABLE II

| | HBED | | HBEDSO | | TMHBED | | MPHBED | | CHBED | |
|---|---|---|---|---|---|---|---|---|---|---|
| Age | HAS (g/l) | $NH_3$ (ppm) | HAS (g/l) | $NH_3$ (ppm) | HAS (g/l) | $NH_3$ (ppm) | HAS (g/l) | $NH_3$ (ppm) | HAS (g/l) | $NH_3$ (ppm) |
| Initial | 3.9 | <1 | 3.9 | <1 | 3.9 | <1 | 3.9 | <1 | 3.9 | <1 |
| 7 days | 3.52 | 2.7 | 3.42 | 4.6 | 3.43 | 2.7 | 3.40 | 3.0 | 3.52 | 3.3 |
| 14 days | 2.72 | 3.3 | 2.69 | 4.1 | 2.80 | 2.5 | 3.11 | 3.8 | 3.04 | 2.7 |

The ammonia levels reported above are low as far as sequestrants in general are concerned and represent no problem in terms of ammonia stain. These results, however, demonstrate that derivatives of HBED can be made which are both blocked in the coupling position and solubilized and still give the good hydroxylamine stability and low ammonia levels as found with HBED.

EXAMPLE 3

Six solutions were prepared and examined for their hydroxylamine content and ammonia level over a three week period. The solutions consisted of potassium carbonate (30.6 g/l), hydroxylamine sulfate (HAS) at 3.9 g/l and ferric nitrate at 0.072 g/l; 10 ppm iron. To this stock solution 1,3-diamino-2-propanol N,N,N',N'-tetraacetic acid (DPTA) and N,N'-bis(2-hydroxybenzyl)ethylenediamine N,N'-diacetic acid (HBED) were added. Results obtained are shown in Table III.

TABLE III

| | DPTA | HBED | Ammonia level (ppm) | | | HAS level (g/l) | | |
|---|---|---|---|---|---|---|---|---|
| Solution | g/l | g/l | 1 week | 2 weeks | 3 weeks | 1 week | 2 weeks | 3 weeks |
| 1 | 0 | 0 | 7.5 | 19.8 | 23.6 | 3.16 | 1.74 | 0.74 |
| 2 | 2 | 0 | 120.8 | 120.8 | 117.4 | 1.58 | 0.35 | 0.41 |
| 3 | 2 | 0.1 | 2.8 | 2.6 | 3.9 | 3.87 | 2.59 | 1.63 |
| 4 | 2 | 0.2 | 2.2 | 2.2 | 3.1 | 3.81 | 3.13 | 2.78 |
| 5 | 2 | 0.4 | 1.8 | 2.3 | 2.8 | 3.81 | 2.98 | 2.53 |
| 6 | 2 | 0.8 | 1.3 | 3.1 | 3.9 | 3.98 | 3.16 | 2.67 |

DPTA is normally included in developer solutions as an anti-calcium agent. However, in the presence of traces of iron, it severely lowers the stability of hydroxylamine, as illustrated by solution 2 in Table (III). Small quantities of HBED however eliminate the detrimental effects of DPTA and give low ammonia levels and stable HAS solutions as illustrated by solutions 3–6.

EXAMPLE 4

This is similar to Example 3 except that DPTA was replaced by EDTA. The solution compositions and results are shown in Table IV.

TABLE IV

| | EDTA | HBED | Ammonia level (ppm) | | | HAS level (g/l) | | |
|---|---|---|---|---|---|---|---|---|
| Solution | g/l | g/l | 1 week | 2 weeks | 3 weeks | 1 week | 2 weeks | 3 weeks |
| 1 | 0 | 0 | 7.5 | 19.8 | 23.6 | 3.16 | 1.74 | 0.74 |
| 2 | 2 | 0 | 183.6 | 137.8 | 106.6 | 0.20 | 0.30 | 0.22 |
| 3 | 2 | 0.1 | 120.8 | 100.4 | 71.4 | 0.54 | 0.25 | 0.30 |
| 4 | 2 | 0.2 | 49.8 | 47.4 | 49.8 | 2.02 | 1.34 | 0.20 |
| 5 | 2 | 0.4 | 25.8 | 25.8 | 23.6 | 3.46 | 2.26 | 1.61 |
| 6 | 2 | 0.8 | 14.8 | 13.8 | 12.4 | 3.65 | 2.43 | 1.83 |

The results in Table IV show the effect of HBED in lowering the detrimental effects of EDTA. The effect of HBED is less dramatic than in the case of its combination with DPTA.

EXAMPLE 5

This is similar to Example 3 except that DPTA was replaced by DTPA. The solution compositions and the results are shown in Table V.

TABLE V

| | DTPA | HBED | Ammonia level (ppm) | | | HAS level (g/l) | | |
|---|---|---|---|---|---|---|---|---|
| Solution | g/l | g/l | 1 week | 2 weeks | 3 weeks | 1 week | 2 weeks | 3 weeks |
| 1 | 0 | 0 | 7.5 | 19.8 | 23.6 | 3.16 | 1.74 | 0.74 |
| 2 | 2 | 0 | 23.4 | 37.2 | 39.0 | 2.92 | 1.91 | 0.98 |
| 3 | 2 | 0.1 | 19.8 | 27.0 | 23.6 | 2.86 | 1.85 | 0.84 |
| 4 | 2 | 0.2 | 17.0 | 23.6 | 24.7 | 2.92 | 2.13 | 1.44 |
| 5 | 2 | 0.4 | 13.8 | 14.8 | 14.0 | 3.08 | 2.45 | 1.85 |
| 6 | 2 | 0.8 | 8.0 | 7.5 | 7.8 | 3.19 | 2.70 | 2.40 |

DTPA is known to give modest HAS stability and, when used alone (solution 2), it does not give results very much worse than the control without any calcium-chelating compound (solution 1). HBED however improves on DTPA still further, although the effect is not so dramatic as with DPTA and the final stability results are not as good as for DPTA/HBED combinations.

EXAMPLE 6

Developer replenisher solutions of the composition set out below were prepared containing no sequestrant. Stabilizer combinations were added to the solution at the concentrations indicated below, and the pH was adjusted to 10.03±0.05. Distilled water was used throughout the experiments. Solutions were "contaminated" with 2.0 mg/l of iron by adding 2.0 ml/l of a 3.56 g/l ferrous chloride tetrahydrate ($FeCL_2.4H_2O$) solution. The solutions were kept at room temperature in open, 1-liter, graduated cylinders and in tightly-capped 120-ml brown glass bottles. Periodically, the HAS and ammonia concentrations were determined. Before sampling the open cylinders, distilled water was added to each solution to account for evaporation. The results are shown in Table VI. Comparative data are also given in respect of DPTA, NTA, EDTA and NTPA (nitrilo-N,N,N-trimethylenephosphonic acid) when used alone.

| Component | Replenisher Concentration g/l |
|---|---|
| Potassium carbonate | 37.5 |
| Sodium bromide | 0.9 |
| Sodium metabisulfite | 3.38 |
| Potassium hydroxide | 1.67 |
| Hydroxylamine sulfate | 2.80 |
| 4-(N—ethyl-N—2-hydroxyethyl)-2-methylphenylenediamine sulfate | 5.25 |
| pH | 10.03 |

TABLE VI

| Stabilizing Agents g/l | | HAS loss g/day | | $NH_3$ range mg/l 1 week/5 week | |
|---|---|---|---|---|---|
| | | Open | Closed | Open | Closed |
| HBED | (2.3) | 0.021 | 0.010 | 0.7/1.0 | 1.6/3.6 |
| HBED | (0.56) | 0.022 | 0.013 | 0.9/1.3 | 1.6/7.5 |
| DPTA | (1.88) | | | | |
| HBED | (0.30) | 0.022 | 0.008 | 1.5/1.91 | 8.6/6.1 |
| NTA | (1.48) | | | | |
| HBED | (0.30) | 0.026 | 0.013 | 2.0/1.1 | 14/20 |
| EDTA | (2.27) | | | | |
| HBED | (0.30) | | | | |
| NTPA | (0.56) | 0.023 | 0.007 | 6.1/1.2 | 9.0/8.6 |
| DPTA | (2.5) | 0.099 | 0.094 | 58/7.6 | 55/180 |
| NTA | (1.480) | 0.271* | 0.267* | 57/— | 117/233 |
| EDTA | (2.27) | 0.330* | 0.337* | 64/— | 174/179 |
| NTPA | (0.56) | 0.217* | 0.220* | 53/20 | 112/157 |

*Zero time and 1-week data points only were used.

The results show that HBED improves stability better than any of the prior art sequestrants and that small amounts of HBED in combination with the prior art sequestrants also give substantial improvements.

EXAMPLE 7

The calcium controlling ability of HBED and its derivatives was estimated by a turbidimetric titration with calcium acetate (44.1 g/l) into 50 ml of a solution (1) containing 0.35 g of HBED or its derivatives. From this the amount of calcium carbonate controlled per gram of sequestrant is obtained. The basic composition of solution (1) was:

| Solution (1) | |
|---|---|
| Component | Concentration (g/l) |
| Benzyl alcohol | 15 |

-continued

| Solution (1) | |
|---|---|
| Component | Concentration (g/l) |
| Triethanolamine (80% by weight solution) | 12.4 |
| Hydroxylamine sulfate | 3.2 |
| Lithium chloride | 1.6 |
| Potassium chloride | 0.1 |
| Potassium sulfite (65% by weight solution) | 4.2 |
| Potassium hydroxide (45% by weight solution) | 4.9 |
| Potassium carbonate | 22.4 |
| pH | 10.0 |

The pH was maintained at 10.0 by addition of potassium hydroxide as the titration progressed. The end point was determined by the appearance of a persistent turbidity.

The calcium controlling properties of these sequestrants is shown below.

| Calcium controlling properties | | |
|---|---|---|
| Compound | mg $CaCO_3$ controlled per g sequestrant | calculated level based on 1:1 Ca complex |
| HBED.HBr.$H_2O$ | 226 | 205 |
| CHBED | 200 | 199 |
| MPHBED | 143 | 169 |
| TMHBED | 14 | 226 |
| NONE | 5.6 | — |

As the results indicate TMHBED has little calcium-sequestering power, but will show special advantages when used in combination with a calcium sequestrant such as NTA (See Example 8 below).

EXAMPLE 8

Solutions were prepared as follows:

| Solution Composition | |
|---|---|
| Component | Concentration |
| $K_2CO_3$ | 30.6 g/l |
| NTA (disodium salt) | 1.5 g/l |
| HBED and derivatives | See Table (VIII) |
| $Fe(NO_3)_3.9H_2O$ | 0.072 g/l (≡10 ppm Iron) |
| HAS | 3.9 g/l |
| pH = | 10.0 |

These solutions were prepared in the chemical order listed, from top to bottom. HAS was the last component added and was added as a solution adjusted to pH 10.0. Samples (200 ml) of solution were prepared and placed in 250 ml amber bottles in a water thermostat at 25° C. Samples were withdrawn from time to time for hydroxylamine and ammonia analysis.

The results are shown in Table VII below.

TABLE VII

| Solution | | Stability after 1 week | |
|---|---|---|---|
| NTA g/l | HBED g/l | Ammonia (ppm) | HAS level g/l |
| 1.5 | 0 | 172 | 0.24 |
| " | 0.1 | 7.9 | 2.87 |
| " | 0.2 | 1.8 | 3.24 |
| " | 0.4 | 1.5 | 3.38 |
| " | 0.8 | 1.5 | 3.41 |

TABLE VII-continued

| Solution NTA g/l | | Stability after 1 week Ammonia (ppm) | HAS level g/l |
|---|---|---|---|
| | TMHBED g/l | | |
| 1.5 | 0.1 | 1.6 | 3.34 |
| " | 0.2 | 1.7 | 3.42 |
| " | 0.4 | 1.5 | 3.46 |
| " | 0.8 | 1.3 | 3.52 |
| | MPHBED g/l | | |
| 1.5 | 0.1 | 160 | 0.16 |
| " | 0.2 | 1.7 | 3.36 |
| " | 0.4 | 1.8 | 3.46 |
| " | 0.8 | 1.6 | 3.44 |
| | CHBED g/l | | |
| 1.5 | 0.1 | 160 | 0.33 |
| " | 0.2 | 1.4 | 3.21 |
| " | 0.4 | 1.5 | 3.14 |
| " | 0.8 | 1.4 | 3.24 |

From these results, it is clear that NTA used by itself generates high ammonia levels and most of the hydroxylamine has been lost after one week. In the presence of small amounts of HBED and its derivatives, the ammonia level and HAS loss are lowered. The effectiveness of the different HBED derivatives however, is not the same; TMHBED shows a significant improvement in stability over HBED and the other derivatives, especially at the lowest concentration. The HAS level at only 0.1 g/l TMHBED is outstanding.

These results indicate that derivatives of HBED can be made which, when used in combination with a calcium ion sequestering agent, such as NTA, give improved stability over that of HBED when used in combination with NTA. At the same time these derivatives do not significantly complex calcium ion in their own right and so can be fully utilized in complexing iron.

EXAMPLE 9

The performance of the combination of DTPA and HEDPA (1-hydroxyethane-1,1-diphosphonic acid) described in Example 1 of British Pat. No. 1,420,656 was compared to HBED, TMHBED and combinations therewith. A method of testing closely similar to that of the patent specification was adopted wherein no deliberate contamination with iron was introduced.

The following solution was made up using demineralized water:

| | |
|---|---|
| Benzyl alcohol | 18.8 g/l |
| Triethanolamine (80% by weight) | 15.5 g/l |
| HAS | 4.0 g/l |
| Lithium chloride | 2.0 g/l |
| Potassium chloride | 0.13 g/l |
| 4-(N—ethyl-N—2-methanesulfonylaminoethyl)-2-methylphenylenediamine sesquisulfate monohydrate | 6.5 g/l |
| Potassium sulfate (65% by weight aqueous solution) | 5.2 g/l |
| Potassium hydroxide (48% by weight aqueous solution) | 6.1 g/l |
| Potassium carbonate | 28.0 g/l |
| pH | 10.3 |

The sequestrants were added as indicated in Table VIII below and the solutions were kept in stoppered bottles for 3 days at 50° C. Initial concentrations were found on analysis to be: HAS, 3.77 g/l and ammonia less than 1 ppm. The results are listed below in Table VIII.

TABLE VIII

| Stabilizing agent (g/l) | | HAS level after 3 days (g/l) | $NH_3$ level after 3 days (ppm) |
|---|---|---|---|
| DTPA | (4) | 3.13 | 5.8 |
| HEDPA | (4.35) | 3.20 | 2.8 |
| DTPA | (4) | 3.35 | 3.7 |
| HEDPA | (4.35) | | |
| HBED | (0.4) | 3.42 | 2.7 |
| HBED | (0.4) | 3.39 | 2.9 |
| DTPA | (4) | | |
| TMHBED | (0.4) | 3.53 | 2.3 |
| TMHBED | (0.4) | 3.45 | 3.1 |
| DTPA | (4) | | |

The results show that small concentrations of HBED or TMHBED alone are more effective than the prior art combination and that a small quantity of HBED or TMHBED in combination with DTPA can improve the performance of DTPA to a similar extent to that of a larger quantity of HEDPA.

As shown by the above examples, the polyamino stabilizing agents of this invention which have substituents in addition to the hydroxyl group on each aromatic ring are especially advantageous. Preferred examples of such substituents are alkyl, carboxyalkyl, and alkoxy groups. Included among the many advantages provided by such compounds are the following:

(1) excellent performance in regard to stabilizing hydroxylamine against aerial oxidation;

(2) excellent performance in providing low ammonia levels;

(3) an ability to stabilize hydroxylamine even when used at very low concentrations levels;

(4) an ability to form a very strong iron III complex, which is an important factor in counteracting the iron catalyzed decomposition of hydroxylamine; and (5) only limited ability to complex calcium ion, which is particularly advantageous in high calcium environments since the iron complexing power will not be significantly depleted by competition with calcium.

The invention has been described in detail with particular reference to preferred embodiments thereof, but it will be understood that variations and modifications can be effected within the spirit and scope of the invention.

We claim:

1. A photographic color developing composition comprising:

(1) a primary aromatic amino color developing agent, (2) an hydroxylamine, and (3) a compound of the formula:

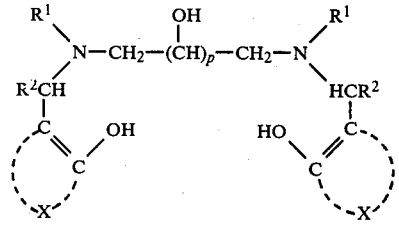

wherein each $R^1$ is $—CH_2COOH$ or

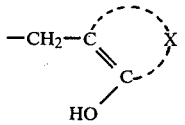

each $R^2$ is hydrogen or —COOH p is 0 or 1, and

X represents the atoms necessary to complete an aromatic nucleus.

2. A photographic color developing composition comprising:

(1) a primary aromatic amino color developing agent, (2) an hydroxylamine, and (3) a compound of the formula:

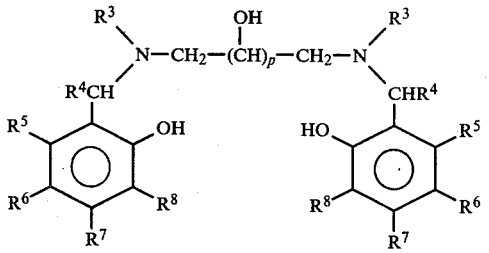

wherein each $R^3$ is $—CH_2—COOH$, or

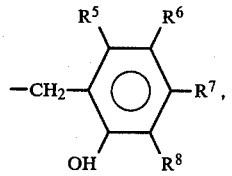

each $R^4$ is hydrogen or —COOH, each $R^5$, $R^6$, $R^7$ and $R^8$ is hydrogen, —COOH, $—SO_3H$, alkyl of 1 to 4 carbon atoms optionally substituted by a —COOH, $—SO_3H$, or —OH group, alkoxy of 1 to 4 carbon atoms optionally substituted by a —COOH, $—SO_3H$ or —OH group or each $R^6$ together with $R^5$ or $R^7$, or each $R^8$ together with $R^7$ represents a fused benzene ring, and p is 0 or 1.

3. A photographic color developing composition as claimed in claim 2 wherein each $R^3$ is $—CH_2—COOH$.

4. A photographic color developing composition as claimed in claim 1 wherein said primary aromatic amino color developing agent is a p-phenylenediamine.

5. A photographic color developing composition as claimed in claim 1 wherein said primary aromatic amino color developing agent is an aminophenol.

6. A photographic color developing composition as claimed in claim 1 wherein said primary aromatic amino color developing agent is 4-(N-ethyl-N-2-methanesulfonylaminoethyl)-2-methylphenylenediamine sesquisulfate monohydrate.

7. A photographic color developing composition as claimed in claim 1 wherein said primary aromatic amino color developing agent is 4-(N-ethyl-N-2-hydroxyethyl)-2-methylphenylenediamine sulfate.

8. A photographic color developing composition as claimed in claim 1 wherein said hydroxylamine is hydroxylamine sulfate.

9. A photographic color developing composition as claimed in claim 1 further containing an additional sequestering agent.

10. A photographic color developing composition as claimed in claim 9 wherein said additional sequestering agent is nitrilotriacetic acid.

11. A photographic color developing composition as claimed in claim 9 wherein said additional sequestering agent is ethylenediaminetetraacetic acid.

12. A photographic color developing composition as claimed in claim 9 wherein said additional sequestering agent is 1,3-diamino-2-propanol-N,N,N',N'-tetraacetic acid.

13. A photographic color developing composition as claimed in claim 9 wherein said additional sequestering agent is diethylenetriaminepentaacetic acid.

14. A photographic color developing composition as claimed in claim 1 further containing an aminopolyphosphonic acid sequestering agent.

15. A photographic color developing composition as claimed in claim 1 wherein compound (3) is selected from the group consisting of:

N,N'-bis(2-hydroxybenzyl)ethylenediamine-N,N'-diacetic acid

N,N'-bis(3-[2-carboxyethyl]-6-hydroxy-5-methoxybenzyl)ethylenediamine-N-N'-diacetic acid N,N'-bis(3-carboxymethyl-6-hydroxybenzyl)ethylenediamine-N,N'-diacetic acid N,N'-bis(3,5-dimethyl-6-hydroxybenzyl)ethylenediamine-N,N'-diacetic acid and N,N'-bis(3-sulfo-6-hydroxybenzyl)ethylenediamine-N,N'-diacetic acid.

16. A photographic color developing composition comprising:

(1) 4-(N-ethyl-N-2-methanesulfonylaminoethyl)-2-methylphenylenediamine sesquisulfate monohydrate, (2) hydroxylamine sulfate, and (3) N,N'-bis(2-hydroxybenzyl)ethylenediamine-N,N'-diacetic acid.

17. A photographic color developing composition comprising:

(1) 4-(N-ethyl-N-2-hydroxyethyl)-2-methylphenylenediamine sulfate, (2) hydroxylamine sulfate, and (3) N,N'-bis(2-hydroxybenzyl)ethylenediamine-N,N'-diacetic acid.

18. A photographic color developing composition comprising:

(1) a primary aromatic amino color developing agent, (2) an hydroxylamine, (3) nitrilotriacetic acid, and (4) N,N'-bis(2-hydroxybenzyl)ethylenediamine-N,N'-diacetic acid.

19. A photographic color developing composition comprising:

(1) a primary aromatic amino color developing agent, (2) an hydroxylamine, (3) nitrilotriacetic acid, and (4) N,N'-bis(3,5-dimethyl-6-hydroxybenzyl)ethylenediamine-N,N'-diacetic acid.

20. A process of color developing a photographic element which comprises contacting said element with a color developing composition comprising:

(1) a primary aromatic amino color developing agent, (2) an hydroxylamine, and (3) a compound of the formula:

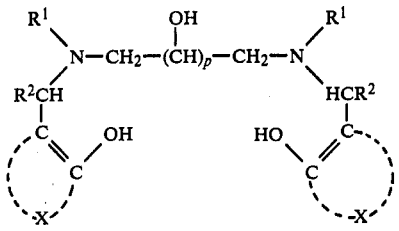

wherein each $R^1$ is $-CH_2COOH$ or

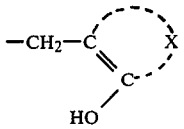

each $R^2$ is hydrogen or —COOH p is 0 or 1, and

X represents the atoms necessary to complete an aromatic nucleus.

21. A process as claimed in claim 20 wherein said primary aromatic amino color developing agent is a p-phenylenediamine.

22. A process as claimed in claim 20 wherein said primary aromatic amino color developing agent is an aminophenol.

23. A process as claimed in claim 20 wherein said primary aromatic amino color developing agent is 4-(N-ethyl-N-2-methane-sulfonylaminoethyl)-2-methylphenylenediamine sesquisulfate monohydrate.

24. A process as claimed in claim 20 wherein said primary aromatic amino color developing agent is 4-(N-ethyl-N-2-hydroxyethyl)-2-methylphenylenediamine sulfate.

25. A process as claimed in claim 20 wherein said color developing composition further contains an additional sequestering agent.

26. A process as claimed in claim 20 wherein compound (3) is selected from the group consisting of:

N,N'-bis(2-hydroxybenzyl)ethylenediamine-N,N'-diacetic acid

N,N'-bis(3-[2-carboxyethyl]-6-hydroxy-5-methoxybenzyl)ethylenediamine-N-N'-diacetic acid N,N'-bis(3-carboxymethyl-6-hydroxybenzyl)ethylenediamine-N,N'-diacetic acid N,N'-bis(3,5-dimethyl-6-hydroxybenzyl)ethylenediamine-N,N'-diacetic acid and N,N'-bis(3-sulfo-6-hydroxybenzyl)ethylenediamine-N,N'-diacetic acid.

27. A method of stabilizing a photographic color developing composition comprising a primary aromatic amino color developing agent and an hydroxylamine, which method comprises incorporating in said composition a stabilizing amount of a compound of the formula:

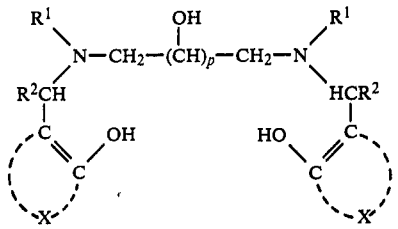

wherein each $R^1$ is $-CH_2COOH$ or

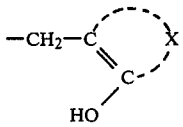

each $R^2$ is hydrogen or —COOH p is 0 or 1, and

X represents the atoms necessary to complete an aromatic nucleus.

28. A method of stabilizing a photographic color developing composition comprising a primary aromatic amino color developing agent and an hydroxylamine, which method comprises incorporating in said composition a stabilizing amount of a compound selected from the group consisting of:

N,N'-bis(2-hydroxybenzyl)ethylenediamine-N,N'-diacetic acid

N,N'-bis(3-[2-carboxyethyl]-6-hydroxy-5-methoxybenzyl)ethylenediamine-N-N'-diacetic acid N,N'-bis(3-carboxymethyl-6-hydroxybenzyl)ethylenediamine-N,N'-diacetic acid N,N'-bis(3,5-dimethyl-6-hydroxybenzyl)ethylenediamine-N,N'-diacetic acid and N,N'-bis(3-sulfo-6-hydroxybenzyl)ethylenediamine-N,N'-diacetic acid.

29. A method of stabilizing a photographic color developing composition comprising a primary aromatic amino color developing agent and an hydroxylamine, which method comprises incorporating in said composition a stabilizing amount of both a compound selected from the group consisting of:

nitrilotriacetic acid ethylenediaminetetraacetic acid 1,3-diamino-2-propanol-N,N,N',N'-tetraacetic acid, and diethylenetriaminepentaacetic acid and a compound selected from the group consisting of:

N,N'-bis(2-hydroxybenzyl)ethylenediamine-N,N'-diacetic acid

N,N'-bis(3-[2-carboxyethyl]-6-hydroxy-5-methoxybenzyl)ethylenediamine-N-N'-diacetic acid N,N'-bis(3-carboxymethyl-6-hydroxybenzyl)ethylenediamine-N,N'-diacetic acid N,N'-bis(3,5-dimethyl-6-hydroxybenzyl)ethylenediamine-N,N'-diacetic acid and N,N'-bis(3-sulfo-6-hydroxybenzyl)ethylenediamine-N,N'-diacetic acid.

30. A method of stabilizing a photographic color developing composition comprising 4-(N-ethyl-N-2-hydroxyethyl)-2-methylphenylenediamine sulfate and hydroxylamine sulfate, which method comprises incorporating in said composition a stabilizing amount of nitrilotriacetic acid and N,N'-bis(3,5-dimethyl-6-hydroxybenzyl)ethylenediamine-N,N'-diacetic acid.

* * * * *